US005856000A

United States Patent [19]

Mizukami et al.

[11] Patent Number: 5,856,000

[45] **Date of Patent: *Jan. 5, 1999**

[54] THERMAL TRANSFER SHEET

[75] Inventors: Fumihiko Mizukami; Masafumi Hayashi; Toshisato Hirano, all of Tokyo, Japan

[73] Assignee: Dai Nippon Printing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 589,705

[22] Filed: Jan. 22, 1996

[30] Foreign Application Priority Data

Jan. 23, 1995 [JP] Japan ..... 7-025778

[51] Int. Cl.[6] ..... B41M 5/26

[52] U.S. Cl. ..... 428/327; 428/195; 428/480; 428/913; 428/914

[58] Field of Search ..... 428/195, 327, 428/484, 488.1, 488.4, 212, 480, 913, 914

[56] References Cited

U.S. PATENT DOCUMENTS 4,960,632 10/1990 Tohma et al. ..... 428/195
4,970,119 11/1990 Koshizuka et al. ..... 428/195

*Primary Examiner*—Pamela R. Schwartz
*Attorney, Agent, or Firm*—Parkhurst & Wendel, L.L.P.

[57] ABSTRACT

A thermal transfer sheet including: a substrate film, and a release layer, a thermal transfer ink layer, and an adhesive layer provided in that order on one side of the substrate film, the release layer being composed mainly of resin particles which, upon thermal transfer of the ink layer, are fused into a film.

5 Claims, No Drawings

THERMAL TRANSFER SHEET

BACKGROUND OF THE INVENTION

1. Field of the Invention

The present invention relates to a thermal transfer sheet and more particularly to a thermal transfer sheet which can produce a high-quality image even on a paper having a rough surface.

2. Background Art

A thermal transfer sheet comprising a substrate film having a thermal transfer ink layer on one side thereof has hitherto been used for carrying out output printing for a computer or a word processor.

This conventional thermal transfer sheet is prepared by coating a mixture of wax with a colorant, such as a pigment or a dye, onto a substrate film of a paper, such as a 10 to 20 μm-thick capacitor paper or paraffin paper, or a plastic film, such as a 3 to 20 μm-thick polyester or cellophane film, to form a thermal transfer ink layer on the substrate film.

One drawback of the conventional thermal transfer sheet is that, when a rough paper having a poor surface smoothness is used as an object for printing, a transferred ink layer as a print has void-like defects or dropouts, making it impossible to provide a good print.

Various proposals have been made with a view to eliminating the above drawback. For example, Japanese Patent Laid-Open No. 59747/1994 proposes a thermal transfer sheet comprising; a substrate film; and a hot-melt layer (a release layer) composed mainly of wax, a color layer (a thermal transfer ink layer) unmeltable at the time of thermal transfer, and an adhesive layer composed mainly of wax provided in that order on one side of the substrate film.

This thermal transfer sheet has an advantage that, since the release layer is composed mainly of wax, it can be easily melted and brought to a low-viscosity liquid, resulting in improved releasability of the thermal transfer ink layer to provide a high-quality print. This advantage is obtained when the thermal transfer sheet is used in combination with a high-speed printer, for example, a high-speed printer having a serial thermal head used in word processors. The use of low- to medium-speed printers, that is, cold release type printers (printers wherein the melting of the release layer and the transfer of the ink layer do not occur simultaneously and there is a timelag therebetween), however, does not offer this advantage.

The reason for this is that, during the timelag, the melted wax is cooled and becomes viscous or is solidified to create a heat-sealing property, reducing the difference in transferability between a print area and a non-print area. That is, the function of the release layer is lowered, and this tendency becomes significant when the object is a rough paper, posing a problem that no high-precision and high-resolution image can be provided.

Japanese Patent Laid-open No. 183882/1988 proposes a thermal transfer sheet having a layer construction of substrate film/release layer/thermosoftening layer with any one of the layers being colored. This thermal transfer sheet is characterized in that the thermosoftening layer is formed of an emulsion of an ionomer resin (a resin crosslinked with a metal ion). The thermal transfer sheet is described to enable a high-quality print to be provided on a rough paper. In fact, however, the print quality varies depending upon energy applied at the time of thermal transfer, and it is difficult for the energy applied in the low- to medium-speed printer to provide a print having a satisfactorily high quality on a rough paper.

Accordingly, an object of the present invention is to solve the above problems of the prior art and to provide a thermal transfer sheet which can form an image having a high quality on a rough paper.

SUMMARY OF THE INVENTION

According to the present invention, the above object can be attained by a thermal transfer sheet comprising a substrate film, and a release layer, a thermal transfer ink layer, and an adhesive layer provided in that order on one side of the substrate film, the release layer being composed mainly of resin particles which, upon thermal transfer of the ink layer, are fused into a film.

The use of a resin, which is particulate before transfer of the ink layer and, upon transfer of the ink layer, brought to a film, as a main component of the release layer in the thermal transfer sheet enables high-precision and high-resolution printing free from void-like defects or dropouts even on a paper having a very rough surface, let alone a paper having a smooth surface.

DETAILED DESCRIPTION OF THE INVENTION

The present invention will now be described in more detail with reference to preferred embodiments.

The thermal transfer sheet of the present invention basically comprises a substrate, film and a release layer, a thermal transfer ink layer, and an adhesive layer provided in that order on one side of the substrate film.

The substrate film used in the present invention may be any one used in the conventional thermal transfer sheet.

Specific preferred examples of the substrate film include; films of plastics, such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber, and ionomer; papers such as condenser paper and paraffin paper; nonwoven fabrics; and laminates of these materials. Among them, a polyethylene terephthalate film is particularly preferred as the substrate film. The thickness of the substrate film may be varied depending upon the material so as to have suitable strength and thermal conductivity. It is preferably 2 to 25 μm.

The release layer provided on the substrate film is composed mainly of resin particles, wax is used as a binder for the resin particles. Resin particles usable in the present invention include, for example, particles of thermoplastic resins, such as polyethylene, ethylene/vinyl acetate copolymer, ethylene/acrylic acid copolymer (EAA), ethylene/ethyl acrylate copolymer (EEA), polyvinyl alcohol, polystyrene, ionomer. The resin particles are selected by considering an adhesion to the substrate at the time of forming a release layer. In particular, when a polyethylene terephthalate film is used as the substrate, particles of an ionomer resin of a copolymer, of a carboxyl-containing monomer with ethylene, with a metal ion bond introduced between main chains of the polymer by an ion of a metal, for example, an alkali metal, such as sodium, or an alkaline earth metal, such as magnesium, is preferred. Examples of the carboxyl-containing monomer include unsaturated carboxylic acids, such as acrylic acid or methacrylic acid. There is a general tendency that, upon heating, a resin is fused to the substrate. In the present invention, materials should be selected so as to satisfy the requirement: (adhesion between the substrate and the release layer)<(adhesion between the adhesive layer and the object).

Among the above resins, those having a minimum film forming temperature (MFT) of 50° to 120° C. is preferred. When MFT is below 50° C., it is difficult to raise the drying temperature in the formation of a release layer to 50° C. or above, posing a problem associated with the productivity of the thermal transfer sheet. On the other hand, when MFT is above 120° C., the sensitivity is unsatisfactory in printing using the thermal transfer sheet.

The resin should form a release layer in a particulate form, and the release layer preferably has an irregular form. For this reason, the resin particles are used as a resin emulsion (or dispersion) using as a medium water, an organic solvent, or a mixture of water with an organic solvent. The average particle diameter of the resin particles in the emulsion is preferably 0.05 to 10 $\mu$m. When it is less than 0.05 $\mu$m, the advantage of resin particles is lost. On the other hand, when it exceeds 10 $\mu$m, the formation of a layer becomes difficult and it becomes difficult for the particles to be fused to one another at the time of thermal transfer, resulting in unsatisfactory durability, such as abrasion resistance, of the resultant print.

When the release layer is formed using the emulsion of resin particles, examples of the wax used as a binder in combination with the resin particles include microcrystalline wax, carnauba wax, and paraffin wax. Further, other various waxes, such as Fischer-Tropsh wax, various polyethylenes having low molecular weights, Japan wax, beeswax, spermaceti, insect wax, wool wax, shellac wax, candelilla wax, petrolatum, partially modified wax, fatty acid esters, and fatty acid amides can be used. Since these waxes are used in combination with the resin particle emulsion, they are used in the form of an emulsion using, as a medium water, an organic solvent, or a mixture of water with an organic solvent. In this case, the particle diameter of the wax is not particularly limited.

The amount of the resin particles and the amount of the wax are preferably 50 to 90 parts by weight and 50 to 10 parts by weight, respectively, based on 100 parts in total of the resin particles and the wax. When the amount of the wax is less than 10 parts by weight, the adhesion of the release layer to the substrate is so low that the strength of the release layer is unsatisfactory, posing a problem of so-called "delaimination." On the other hand, when the amount of wax exceeds 50 parts by weight, the function of the resin particles is lowered, resulting in lowered print quality particularly on a rough paper.

A mixed emulsion containing the resin particles and the wax in the above proportion is coated on the surface of a substrate film, and the coating is dried to form a release layer. The coverage of the release layer is generally about 0.2 to 5 g/m$^2$ on a solid basis, and the a drying temperature is such that the resin can be maintained in a particulate form, specifically in the range of from about 40° C. to 100°. The drying time varies depending upon the drying temperature, air flow, coverage and the like and, hence, cannot be unconditionally determined. However, it is generally about 1 to 20 seconds.

Then, a thermal transfer ink layer is formed on the surface of the release layer. The thermal transfer ink layer comprises a colorant and a vehicle and may, if necessary, further comprise various additives. The colorant is preferably one having good properties as a recording material selected from organic or inorganic pigments, for example, a colorant having a satisfactory color density and causing no change in color upon being exposed to light, heat, temperature and the like. Further, it may be a substance which is colorless, when in an unheated state, and develops a color upon heating or upon contact with a substance coated in an object. In addition to colorants which form cyan, magenta, yellow, and black, other various colorants may also be used.

The vehicle is composed mainly of a wax, and it is also possible to use a mixture of a wax with a drying oil, a resin, a mineral oil, cellulose, a rubber derivative or the like. In the present invention, however, the vehicle is preferably composed mainly of the same resin particles as those used for forming the release layer. This is for improving the affinity of the release layer and the thermal transfer ink layer for each other because transfer is carried out not by cohesive failure of the release layer but by release of the release layer together with the thermal transfer ink layer from the interface of the release layer and the substrate. Alternatively, for the same reason as described above, the resin particles may be preferably particles of a resin having an MFT of 50° to 120° C. and an average particle diameter of 0.05 to 10 $\mu$m with particles of an ionomer resin being particularly preferred.

Preferably, the resin constitutes the ink layer in the form of particles. For this reason, the resin is used as an emulsion or water dispersion of the resin. The average particle diameter of the resin in the emulsion is preferably 0.05 to 10 $\mu$m for the same reason as described above.

The resin particles are used in an amount of 10 to 90 parts by weight based on 100 parts by weight of the ink layer. When the amount of the resin particles used is less than 10 parts by weight, the thermal transfer of the ink layer on a rough paper is unsatisfactory, while when it exceeds 90 parts by weight, the amount of the colorant in the transfer ink layer becomes small, resulting in unsatisfactory print density.

The ink layer is formed in the same manner as described above in connection with the formation of the release layer. The thickness of the ink layer is generally about 0.3 to 5 $\mu$m.

An adhesive layer is provided on the surface of the ink layer. Preferably, the adhesive layer is formed of the above wax. As with the wax used in the formation of the release layer, the wax is preferably used as an emulsion to form the adhesive layer.

Further, the wax for forming the adhesive layer is selected from those having a lower melt viscosity than the vehicle for forming the ink layer. The adhesive layer functions to seal a rough surface of the object. A colorant of the type described above may be incorporated into the adhesive layer. The content of the colorant is preferably not more than 10% based on the total weight of the surface layer. Further, it is also possible to incorporate resin particles of the type described above into the adhesive layer.

A thickness of about 0 5 to 3 $\mu$m suffices for the adhesive layer to function satisfactorily. The adhesive layer may be formed in the same manner as described above in connection with the formation of the release layer and the thermal transfer ink layer.

The release layer, the ink layer, and the adhesive layer may be formed, for example, by any method using a printing machine or a coater, such as a gravure direct, gravure reverse, hot-melt coating, hot lacquer coating, knife coating, or roll coating method. The gravure direct method is best suited from the viewpoint of economy. The use of the printing method is preferred particularly in the preparation of a multi-color thermal transfer sheet wherein ink layers of two or more colors are coated in a repeated manner on the surface of a continuous substrate film.

Further, according to the present invention, when the substrate film is formed of a material having poor heat resistance, the provision of a heat-resistant slip layer, which functions to improve the slip property of a thermal head and to prevent sticking, is preferred on the substrate film in its surface which comes into contact with a thermal head. The heat-resistant slip layer basically comprises a heat-resistant resin and a substance which functions as a release agent or lubricant in a heated state. The provision of a heat-resistant slip layer enables thermal printing to be carried out without sticking even when the substrate is a plastic film having poor heat resistance. This can utilize advantages of the plastic film, such as good tear resistance and fabricability.

Further, when the formation of a matte image is desired, a matte layer may be provided between the substrate film and the release layer. The matte layer may be formed on a substrate film, for example, by a gravure printing method using an ink, for forming a matte layer, of an inorganic pigment, for example, silica or calcium carbonate, dispersed in a suitable solvent. The thickness of the matte layer is preferably about 0.05 to 1.0 $\mu$m.

The following examples further illustrate the present invention but are not intended to limit it. In the following examples, all "parts" or "%" are by weight unless otherwise specified.

EXAMPLE 1

An ink for a release layer, an ink for a thermal transfer ink layer, and an ink for an adhesive layer, the inks having the following respective compositions, were coated and dried in that order on one side of a 4.5 $\mu$m-thick polyester film remote from a heat-resistant slip layer formed on the back side of the polyester film, thereby preparing the thermal transfer sheet of the present invention.

All the inks were coated with a gravure printing machine, and the resultant coatings were dried at 40° to 50° C. for 10 to 20 sec to form the respective layers.

| Ink for release layer | |
|---|---|
| Water dispersion of EAA (solid content 30%, MFT 60° C., average particle diameter 0.2 $\mu$m) | 1 part |
| Carnauba wax emulsion (solid content 40%) | 4 parts |
| Ethyl alchol/water (2/1) | 10 parts |
| Coverage: 0.5 g/m$^2$ on solid basis | |
| **Ink for thermal transfer ink layer** | |
| Water dispersion of carbon black (solid content 30%) | 6 parts |
| Styrene/acrylate copolymer emulsion (solid content 30%, MFT 0° C., average particle diameter 0.1 $\mu$m) | 6 parts |
| Ethyl alcohol/water (2/1) | 10 parts |
| Coverage: 0.7 g/m$^2$ on solid basis | |
| **Ink for adhesive layer** | |
| Carnauba wax emulsion (solid content 40%) | 10 parts |
| Isopropyl alcohol/water (3/1) | 10 parts |
| Coverage: 0.5 g/m$^2$ on solid basis | |

EXAMPLE 2

The thermal transfer sheet of the present invention was prepared in the same manner as in Example 1, except that the following ink for a release layer was used instead of the ink for a release layer used in Example 1.

| Ink for release layer | |
|---|---|
| Water dispersion of EAA (solid content 30%, MFT 60° C., average particle diameter 0.2 $\mu$m) | 3 parts |
| Carnauba wax emulsion (solid content 40%) | 1 part |
| Ethyl alcohol/water (2/1) | 10 parts |
| Coverage: 0.4 g/m$^2$ on solid basis | |

EXAMPLE 3

The thermal transfer sheet of the present invention was prepared in the same manner as in Example 1, except that the following ink for a release layer was used instead of the ink for a release layer used in Example 1 and the drying conditions were varied as follows.

| Ink for release layer | |
|---|---|
| Water dispersion of ionomer (solid content 35%, MFT 95° C., average particle diameter 0.5 $\mu$m) | 4 parts |
| Carnauba wax emulsion (solid content 40%) | 1 part |
| Ethyl alcohol/water (2/1) | 10 parts |
| Coverage: 0.4 g/m$^2$ on solid basis | |
| Drying conditions: 60 to 70° C., 1 to 15 seconds | |

EXAMPLE 4

The thermal transfer sheet of the present invention was prepared in the same manner as in Example 1, except that the ink for a release layer used in Example 3 was used instead of the ink for release layer used in Example 1 and an ink having the following composition was used for the thermal transfer ink layer.

| Ink for thermal transfer ink layer | |
|---|---|
| Water dispersion of polyethylene (solid content 40%, MFT 90° C., average particle diameter 5 $\mu$m) | 3 parts |
| Water dispersion of carbon black (solid content 30%) | 6 parts |
| Ethyl alcohol/water (2/1) | 5 parts |
| Coverage: 0.4 g/m$^2$ on solid basis | |
| Drying conditions: 60 to 70° C., 1 to 15 seconds | |

EXAMPLE 5

The thermal transfer sheet of the present invention was prepared in the same manner as in Example 1, except that the ink for a release layer used in Example 3 was used instead of the ink for release layer used in Example 1 and an ink having the following composition was used for the thermal transfer ink layer.

| Ink for thermal transfer ink layer | |
|---|---|
| Water dispersion of carbon black (solid content 30%) | 6 parts |
| Water dispersion of ionomer (solid content 27%, MFT 85° C., average particle diameter 0.5 $\mu$m) | 4 parts |
| Ethyl alcohol/water (2/1) | 5 parts |
| Coverage: 0.9 g/m$^2$ on solid basis | |
| Drying conditions: 60 to 70° C., 1 to 15 seconds | |

EXAMPLE 6

The thermal transfer sheet of the present invention was prepared in the Same manner as in Example 1, except that the ink for a release layer used in Example 3 was used instead of the ink for release layer used in Example 1 and an ink having the following composition was used for the thermal transfer ink layer.

| Ink for thermal transfer ink layer | |
|---|---|
| Water dispersion of carbon black (solid content 30%) | 6 parts |
| Water dispersion of ionomer (solid content 27%, MFT 85° C., average particle diameter 0.5 μm) | 4 parts |
| Carnauba wax emulsion (solid content 40%) | 1 part |
| Ethyl alcohol/water (2/1) | 5 parts |
| Coverage: 0.9 g/m$^2$ on solid basis | |
| Drying conditions: 60 to 70° C., 1 to 15 seconds | |

Comparative Example 1

A comparative thermal transfer sheet was prepared in the same manner as in Example 1, except that the following ink for a release layer was used instead of the ink for a release layer used in Example 1.

| Ink for release layer | |
|---|---|
| Carnauba wax emulsion (solid content 40%) | 4 parts |
| Ethyl alcohol/water (2/1) | 10 parts |
| Coverage: 0.5 g/m$^2$ on solid basis | |

Comparative Example 2

A comparative thermal transfer sheet was prepared in the same manner as in Example 1, except that the following ink for a release layer was used instead of the ink for a release layer used in Example 1.

| Ink for release layer | |
|---|---|
| Carnauba wax emulsion (solid content 40%) | 4 parts |
| Water dispersion of ionomer (solid content 35%, MFT 70° C., average particle diameter 0.05 μm) | 4 parts |
| Ethyl alcohol/water (2/1) | 10 parts |
| Coverage: 0.5 g/m$^2$ on solid basis | |
| Drying conditions: 100° C., 1 to 10 seconds | |

Evaluation of Print

Printing was carried out on a paper having a smooth surface and a paper having a rough surface under conditions of 4 kg/width of size B4 and 0.2 mJ/dot (200 dpi), and the quality of the print was evaluated by visual inspection. The results are given in Table 1.

TABLE 1

| Thermal transfer sheet | Paper having smooth surface | | Paper having rough surface | |
|---|---|---|---|---|
| | Solid printing | Hairline printing | Solid printing | Hairline printing |
| Example 1 | ◎ | ◎ | ○ | ○ |
| Example 2 | ◎ | ◎ | ○ | ○ |
| Example 3 | ◎ | ◎ | ○ | ○ |
| Example 4 | ◎ | ◎ | ○ | ○ |
| Example 5 | ◎ | ◎ | ◎ | ◎ |
| Example 6 | ◎ | ◎ | ◎ | ◎ |
| Comparative Example 1 | ○ | ○ | x | x |
| Comparative Example 2 | ○ | ○ | Δ | x |

Evaluation criteria
◎: No dropout or void-like defect of print observed.
○: Few dropouts or void-like defects of print observed.
Δ: Some dropouts or void-like defects of print observed.
x: Considerable dropouts or void-like defects of print observed.

What is claimed is:

1. A thermal transfer sheet comprising:

a substrate film comprising a polyethylene terephthalate film;

a release layer formed directly on one surface of said substrate film, said release layer comprising ionomer resin particles present in said release layer in an amount of 50 to 90% by weight;

a thermal transfer ink layer formed on said release layer; and an adhesive layer formed on said thermal transfer ink layer, wherein the resin particles of said release layer fuse together to form a film upon thermal transfer of said thermal transfer ink layer.

2. The thermal transfer sheet of claim 1, wherein said resin particles have an average particle diameter of 0.1–10 μm.

3. The thermal transfer sheet of claim 1, wherein the thermal transfer ink layer comprises 10–90% by weight of resin particles.

4. The thermal transfer sheet of claim 3, wherein the resin particles contained in said thermal transfer ink layer are the same kind of resin particles as those contained in said release layer.

5. The thermal transfer sheet of claim 1, wherein at least one of said release layer, said thermal transfer ink layer and said adhesive layer is formed by gravure coating.

* * * * *